US007699644B2

(12) United States Patent
Szczesny et al.

(10) Patent No.: US 7,699,644 B2
(45) Date of Patent: Apr. 20, 2010

(54) ELECTRICAL CONNECTOR WITH PROTECTIVE MEMBER

(75) Inventors: David Stanley Szczesny, Hershey, PA (US); Edmund Luther Jacobs, Harrisburg, PA (US); David Keay Fowler, Boiling Springs, PA (US); Edward Eugene Knisely, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/863,494

(22) Filed: Sep. 28, 2007

(65) Prior Publication Data

US 2009/0088003 A1 Apr. 2, 2009

(51) Int. Cl.
*H01R 13/64* (2006.01)

(52) U.S. Cl. ..... 439/377; 439/637

(58) Field of Classification Search ..... 439/325, 439/326, 637, 636, 328, 385, 377, 64
See application file for complete search history.

(56) References Cited

U.S. PATENT DOCUMENTS

| | | | | | |
|---|---|---|---|---|---|
| 4,428,635 | A * | 1/1984 | Hamsher et al. | ..... | 439/265 |
| 4,477,138 | A * | 10/1984 | Andrews et al. | ..... | 439/374 |
| 4,776,805 | A * | 10/1988 | Brown et al. | ..... | 439/64 |
| 4,990,097 | A * | 2/1991 | Billman et al. | ..... | 439/160 |
| 4,995,825 | A * | 2/1991 | Korsunsky et al. | ..... | 439/328 |
| 5,096,435 | A * | 3/1992 | Noschese et al. | ..... | 439/260 |
| 5,112,242 | A * | 5/1992 | Choy et al. | ..... | 439/326 |
| 5,129,831 | A | 7/1992 | Locati | | |
| 5,169,333 | A * | 12/1992 | Yang Lee | ..... | 439/326 |
| 5,211,571 | A * | 5/1993 | Arai et al. | ..... | 439/325 |
| 5,232,400 | A * | 8/1993 | Chang et al. | ..... | 439/326 |
| 5,374,203 | A * | 12/1994 | Sato et al. | ..... | 439/326 |
| 5,389,000 | A * | 2/1995 | DiViesti et al. | ..... | 439/157 |
| 5,393,247 | A * | 2/1995 | DiOrazio et al. | ..... | 439/567 |
| 5,647,755 | A * | 7/1997 | Hida et al. | ..... | 439/328 |
| 5,730,614 | A * | 3/1998 | Yu | ..... | 439/326 |
| 5,906,512 | A * | 5/1999 | Reynolds | ..... | 439/579 |
| 5,975,947 | A * | 11/1999 | Wu et al. | ..... | 439/567 |
| 6,162,069 | A * | 12/2000 | Choy | ..... | 439/92 |
| 6,220,876 | B1 * | 4/2001 | Avila et al. | ..... | 439/76.2 |
| 6,227,898 | B1 | 5/2001 | Mong et al. | | |
| 6,312,279 | B1 * | 11/2001 | Rachui et al. | ..... | 439/377 |
| 6,431,890 | B1 * | 8/2002 | Li et al. | ..... | 439/160 |
| 6,478,592 | B1 * | 11/2002 | Hu et al. | ..... | 439/159 |
| D491,148 | S * | 6/2004 | Zhao et al. | ..... | D13/147 |
| 6,743,028 | B2 * | 6/2004 | Wang | ..... | 439/92 |
| 6,863,572 | B1 * | 3/2005 | Yi et al. | ..... | 439/637 |
| 6,930,889 | B2 * | 8/2005 | Harrison et al. | ..... | 361/774 |
| 7,267,580 | B2 * | 9/2007 | Huang et al. | ..... | 439/637 |
| 7,322,862 | B1 * | 1/2008 | Burrell et al. | ..... | 439/862 |
| D568,249 | S * | 5/2008 | Wu et al. | ..... | D13/133 |
| 2007/0155245 | A1 * | 7/2007 | Tsai | ..... | 439/637 |
| 2007/0249232 | A1 * | 10/2007 | Haneishi | ..... | 439/630 |
| 2008/0050987 | A1 * | 2/2008 | Copper et al. | ..... | 439/781 |

* cited by examiner

*Primary Examiner*—T C Patel
*Assistant Examiner*—Harshad C Patel

(57) ABSTRACT

A connector for connecting a card edge module to a circuit board includes a housing that extends along a longitudinal axis between opposite first and second end portions. The housing including a card slot configured to receive a mating edge of the card edge module and a channel proximate one of the first and second end portions. A protective member is received in the channel and positioned to inhibit contact between a side edge of the card edge module and the one of the first and second end portions of the housing when the card edge module is loaded into the connector.

25 Claims, 4 Drawing Sheets

ELECTRICAL CONNECTOR WITH PROTECTIVE MEMBER

BACKGROUND OF THE INVENTION

The invention relates generally to card edge connectors and, more particularly to a card edge connector with protective members to minimize wear in the connector.

Computers and servers may use numerous types of electronic modules, such as processors, memory, and other types of resource, all of which may be produced in a number of formats. For instance, memory modules may be Single In-line Memory Modules (SIMM's), or the newer Dual In-line Memory Modules (DIMM's) and Fully Buffered DIMM's (FB DIMM's). Networking and telecommunications systems may include modules adhering to various standards such as Advanced Telecommunications Computing Architecture (Advanced TCA) and Micro Telecommunications Computing Architecture (Micro TCA).

Typically, the electronic modules are installed in multi-pin socket connectors mounted on a system board or motherboard. Each module has a card edge that provides an interface generally between two rows of contacts in a card slot of the socket. Conventionally the card edge interface is a separable card edge interface. Some of the cards can be relatively large and when inserted into or extracted from the socket, it is not uncommon that the side edges of the card rub against the socket housing at the ends of the card slot.

The electronic module cards typically include a fiberglass based substrate that is left with relatively rough edges after the manufacturing process. The substrate material is harder than the plastic material of the socket housing such that the side edges of the card may abrade or wear the socket housing at the end of the card slot during insertion and removal. Excessive wear in the socket may cause unreliable mating of the module card with the socket. Thus, a need exists for a socket connector wherein the socket connector is protected from wear or abrasion at the ends of the card slot from contact with the module cards.

BRIEF DESCRIPTION OF THE INVENTION

In one embodiment, a connector for connecting a card edge module to a circuit board is provided. The connector includes a housing that extends along a longitudinal axis between opposite first and second end portions. The housing including a card slot configured to receive a mating edge of the card edge module and a channel proximate one of the first and second end portions. A protective member is received in the channel and positioned to inhibit contact between a side edge of the card edge module and the one of the first and second end portions of the housing when the card edge module is loaded into the connector.

Optionally, the channel is transverse to the card slot. The channel may comprise a recess formed in one of the end portions proximate the card slot. The protective member includes a body having a front surface configured to engage a side edge of the card edge module when the card edge module is loaded into the connector. The protective member includes a retention element including retention bumps and each housing end portion includes a retention slot. The retention bumps are configured to frictionally engage side walls of the retention slot to retain the protective member in the channel. The protective member includes a ramped section configured to engage a mating edge of the card edge module to guide the card edge module into the card slot. A protrusion formed on a rear surface of the protective member engages a rear wall of the channel to bias the protective member toward a longitudinal center of the housing.

In another embodiment, a protective member is provided for an electrical connector configured to receive a card edge module. The protective member includes a planar body having opposite front and rear surfaces. A ramped section extends from the body. The protective member is configured to be received in the connector housing to inhibit contact between the card edge module and an end portion of the connector housing.

DETAILED DESCRIPTION OF THE INVENTION

Figure 1:
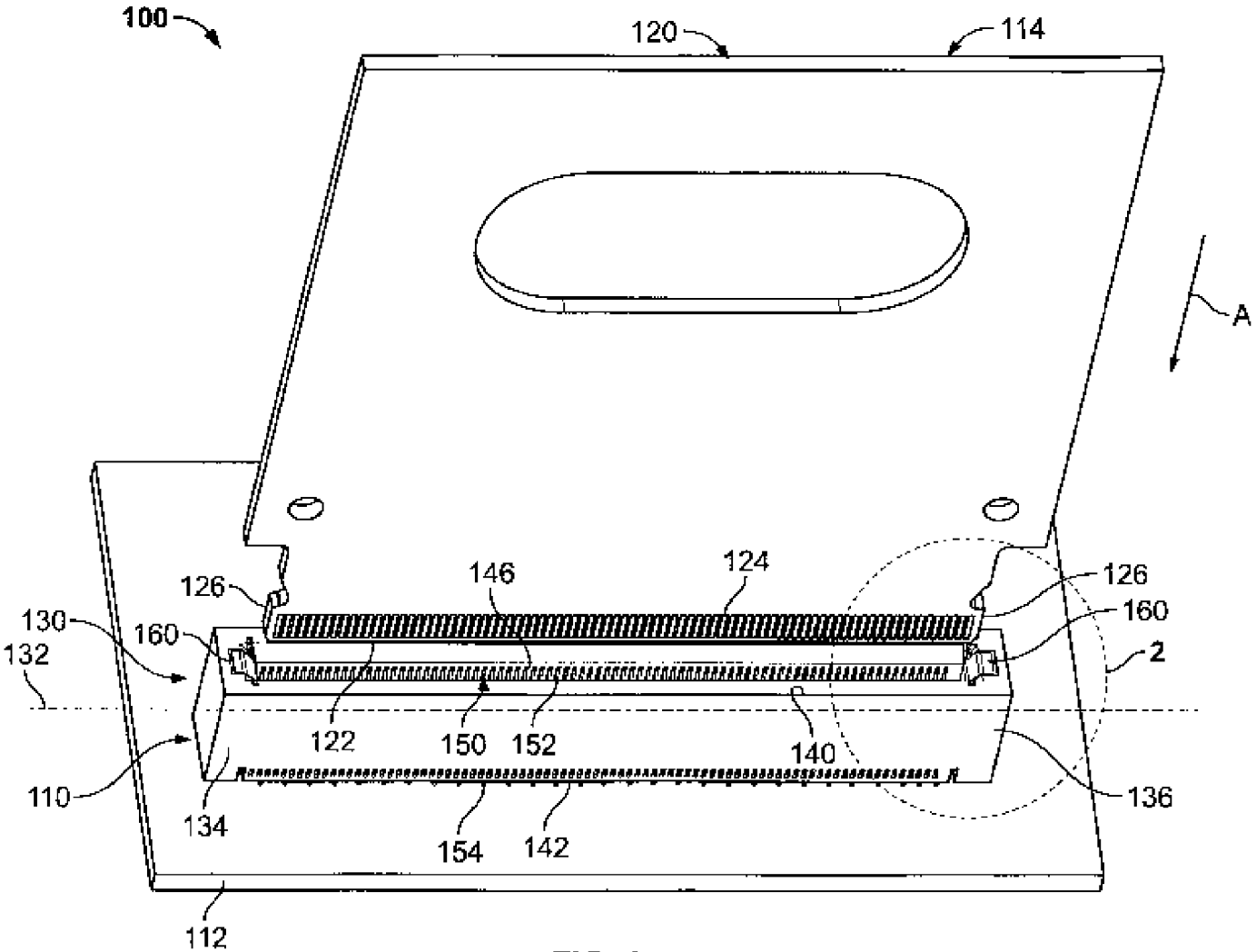
FIG. 1 is a partially exploded view of an electronic assembly including a socket connector formed in accordance with an exemplary embodiment of the present invention.
Figure 2:
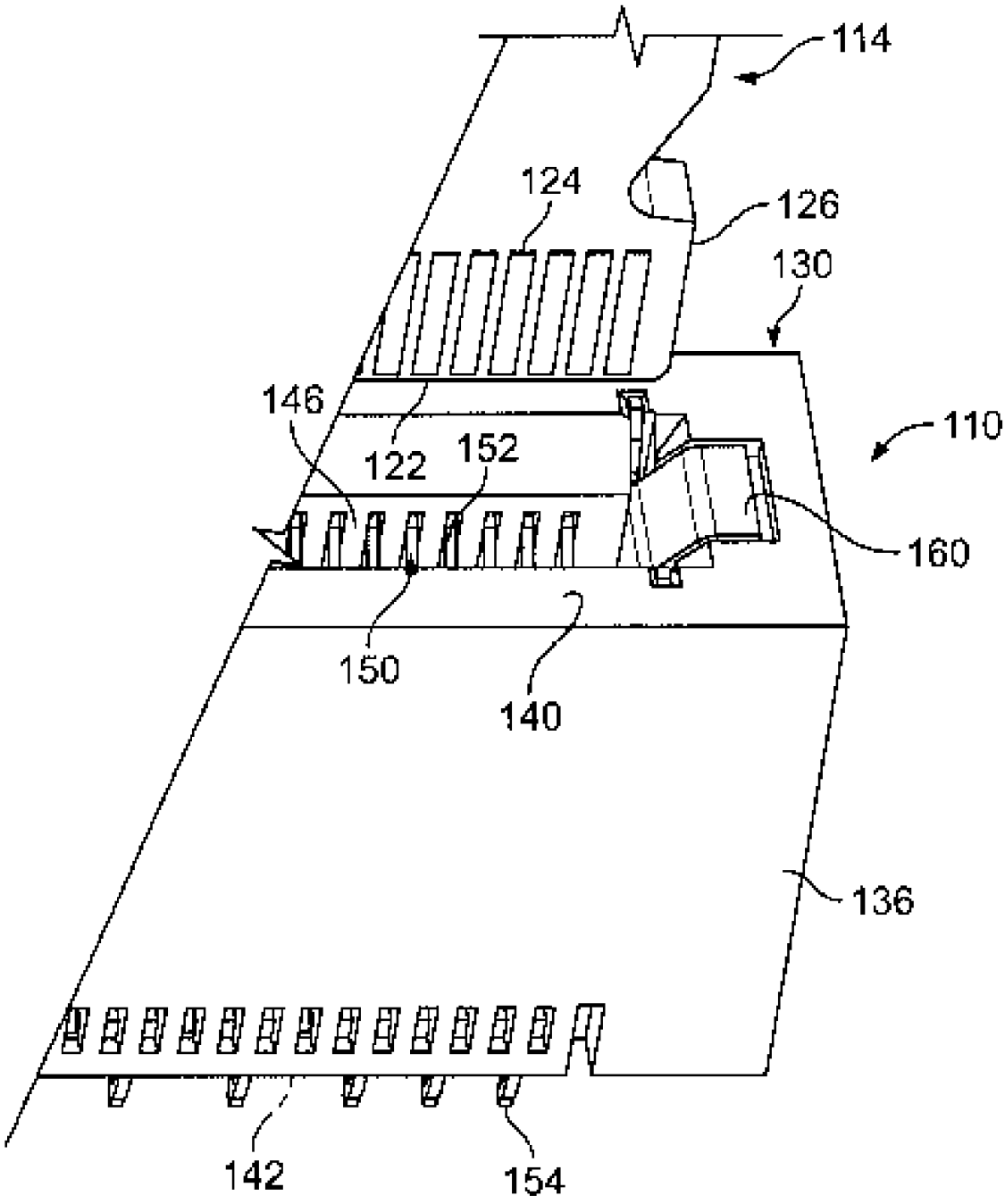
FIG. 2 is a enlarged fragmentary view of one end of the electronic assembly shown in FIG. 1.

FIG. 1 illustrates a partially exploded view of an electronic assembly 100 including a socket connector 110 formed in accordance with an exemplary embodiment of the present invention. FIG. 2 illustrates an enlarged fragmentary view of one end of the electronic assembly 100. The connector 110 is configured to be mounted on a circuit board 112 and receives a card edge module 114 to electrically connect the card edge module 114 to the circuit board 112. The card edge module 114 includes a planar substrate 120 that has a mating edge 122 and a plurality of electrical traces (not shown), each of which terminates at a respective contact pad 124 at the mating edge 122. Side edges 126 of the card edge module 114 extend upwardly from the mating edge 122. The side edges 126 may be either straight or irregular in shape. The substrate 120 may also include electrical components (not shown) mounted thereon. By way of illustration only and intending no limitation, the assembly 100 may be found in a computer, a server, a router, or other telecommunications device. When used in such devices, a latching system (not shown) on the framework of the device may be provided to hold the card edge module 114 in the connector 110.

The connector 110 includes a dielectric housing 130 that extends along a longitudinal axis 132 between first and second opposite end portions 134 and 136. The housing 130 includes an upper face 140, a mounting face 142, and a longitudinally extending card slot 146 that is configured to receive the mating edge 122 of the card edge module 114. The card edge module 114 is loaded into the connector 110 by inserting the mating edge 122 of the card edge module 114 into the card slot 146 in the direction of the arrow A. The housing 130 holds a plurality of electrical contacts 150 having mating ends 152 and contact tails 154. The contacts 150 are arranged in rows on each side of the card slot 146. The contact mating ends 152 extend into the card slot 146 to electrically engage the contact pads 124 on the card edge module 114 when the card edge module 114 is loaded in the connector 110. The contact tails 154 extend from the mounting face 142 and are configured to electrically connect the connector 110 to the circuit board 112 to enable the connection of the card edge module 114 to the circuit board 112. In some embodiments, the connector 110 may be surface mounted to the circuit board 112.

A protective member 160 is provided proximate each end portion 134, 136 of the connector 110. The protective member 160 is positioned to inhibit contact between the side edges 126 of the card edge module 114 and the end portions 134 and 136 of the housing 130 when the card edge module 114 is loaded into the connector 110, thereby shielding the end portions 134 and 136 from wear at the card slot 146.

Figure 4:
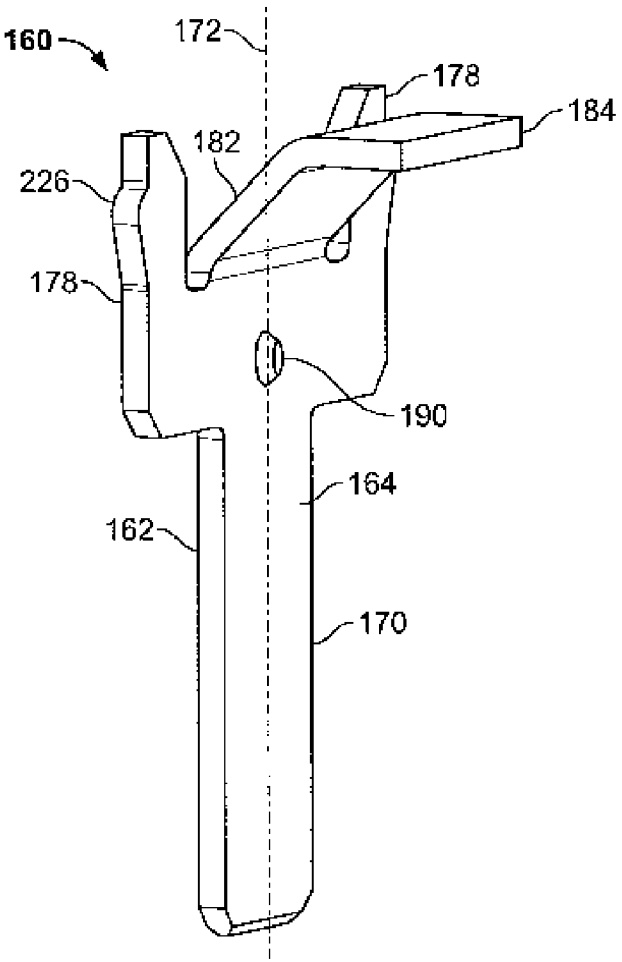
FIG. 4 is a rearward perspective view of the protective member shown in FIG. 3.
Figure 3:
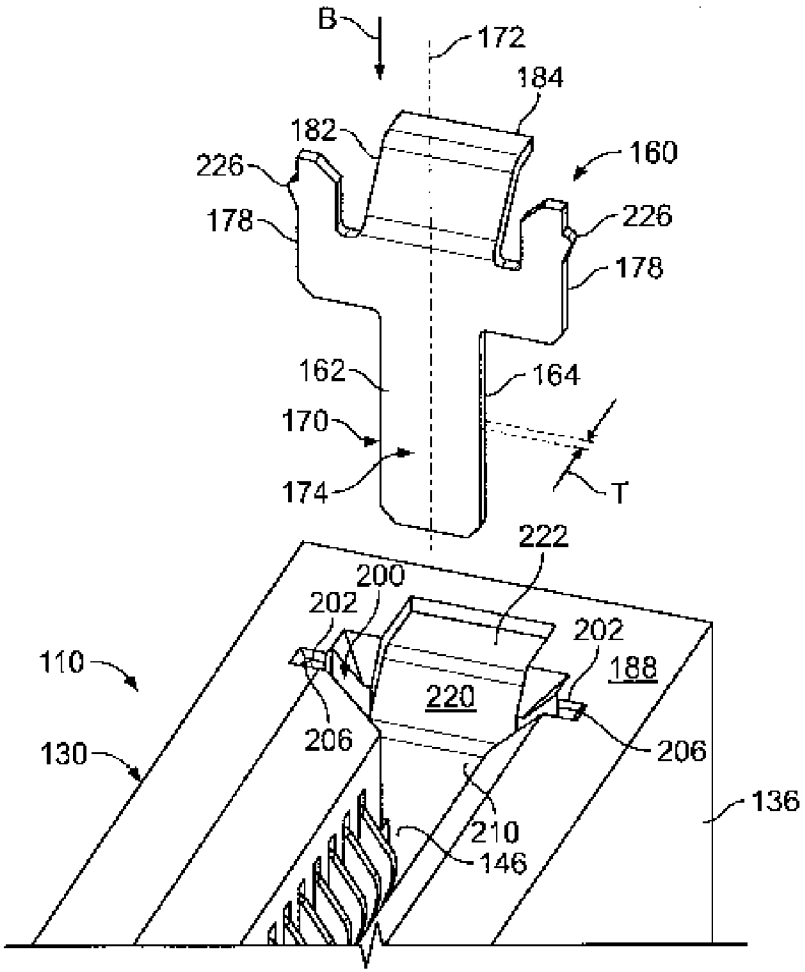
FIG. 3 is an enlarged fragmentary view or one end of the connector shown in FIG. 1 with the protective member removed from the connector.

FIG. 3 illustrates an enlarged fragmentary view of one end portion 136 of the connector 110 with the protective member 160 removed from the housing 130. The housing end portion 134 is identical to the end portion 136 and will not be separately described. FIG. 4 illustrates a rearward perspective view of the protective member 160. The protective member 160 is formed from a planar sheet of material and has a front surface 162 and an opposite rear surface 164 separated by a thickness T. In an exemplary embodiment, the protective member 160 is fabricated from stainless steel. It is to be understood however, that in other embodiments, other materials may be used. More particularly, any material that is harder than or can resist abrasion from the substrate 120 of the card edge module 114 may be used. Stainless steel offers the particular advantage of being durable without plating or coating.

The protective member 160 includes a body 170 that extends along a longitudinal is 172 that may also be an axis of symmetry of the protective member 160. A front surface 174 of the body 170 provides a wear surface that is configured to engage the side edges 126 of the card edge module 114 when the protective member 160 is installed in the housing 130. Retention elements 178 that may comprise retention arms extend laterally and upwardly in a generally L-shape from an upper portion of the body 170. The protective member 160 includes a ramped section 182 that extends upwardly and rearwardly from an upper portion of the body 170 and terminates with an upper section or lip 184 that extends in a direction that is substantially perpendicular to the body 170. When the protective member 160 is installed in the housing 130, the upper section 184 is substantially parallel with an upper surface 188 of the housing 130. A protrusion 190 is formed on the rear surface 164 of the protective member 160. In an exemplary embodiment, the protrusion 190 is positioned between the retention elements 178.

A channel 200 is formed in the housing 130 at each end portion 134 and 136. The channel 200 is transverse to the card slot 146 and is sized to receive the protective member 160. The channel 200 is open to the card slot 146 such that when the protective member 160 is installed in channel 200, the front surface 174 of the body 170 is at least partially exposed to the card slot 146. The channel 200 includes end or corner portions 202 that comprise retention slots having side walls 206. A rear wall 210 of the channel 200 faces the card slot 146. A sloped surface 220 extends rearwardly and upwardly from the rear wall 210 of the channel 200 at substantially the same angle as that of the ramped section 182 of the protective member 160. The sloped surface 220 extends to a recess 222 that is sized to receive the upper section or lip 184.

In use, the protective member 160 is inserted into the channel 200 in the direction of the arrow B which is substantially the same as the loading direction A (FIG. 1) of the card edge module 114 into the connector 110. When the protective member 160 is installed in the channel 200, the retention elements 178 are received in the end portions 202 of the channel 200. Retention bumps 226 on the retention elements 178 are configured to frictionally engage the side walls 206 of the end portions 202 to retain the protective member 160 in the channel 200. When the protective member 160 is fully inserted in the channel 200, the ramped section 182 of the protective member 160 rests on the sloped surface 220 and the lip 184 is seated in the recess 222. The protrusion 190 on the rear surface 164 of the protective member 160 is configured to engage the rear wall 210 of the channel 200 to bias the protective member 160 toward the longitudinal center of the housing 130. In an exemplary embodiment, the protective member 160, once completely installed, is not intended to be removed.

When the protective member 160 is installed in the housing 130, the ramped section 182 acts as a guide to lead the mating edge 122 of the card edge module 114 (see FIG. 2) into the card slot 146. The provision of the ramped section 182 minimizes damage to the mating edge 122 of the card edge module 114 during loading that might result from impact with an edge of the housing 130 that would otherwise be present at the end of the card slot 146. As the card edge module 114 is seated in the card slot 146, the exposed front surface 174 of the protective member body 170 engages the side edges 126 (FIG. 2) of the card edge module 114 thereby shielding the housing end portion 134, 136 from abrasion and wear.

Figure 5:
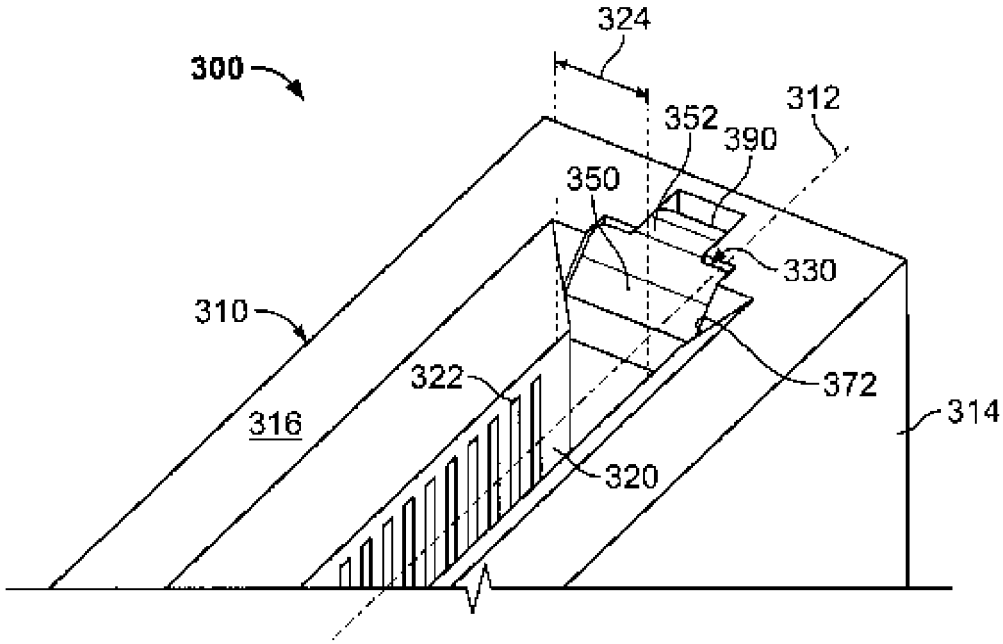
FIG. 5 is a fragmentary view of a connector formed in accordance with an alternative embodiment of the present invention.
Figure 6:
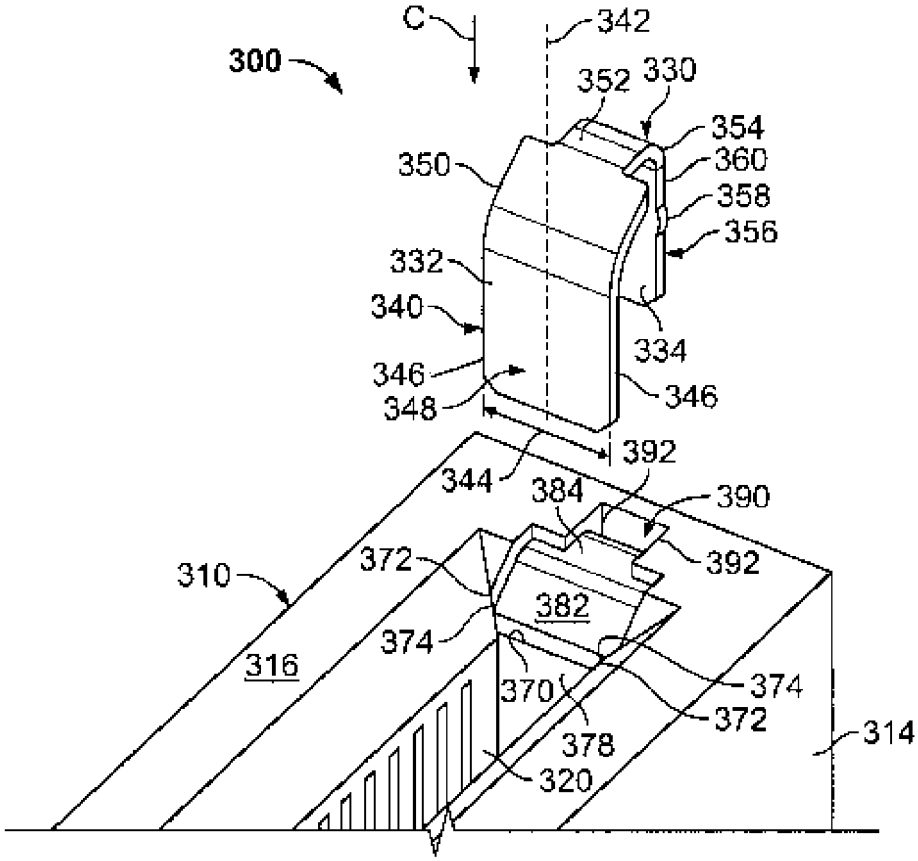
FIG. 6 is a fragmentary view of the connector shown in FIG. 5 with the protective member removed from the connector.

FIG. 5 illustrates a fragmentary view of a connector 300 formed in accordance with an alternative embodiment of the present invention. FIG. 6 illustrates an exploded view of the connector 300. The connector 300 includes a dielectric housing 310 that that extends along a longitudinal axis 312 between a first end portion 314 and an identical opposite second end portion that is not shown. The housing 310 includes an upper face 316, a mounting face that is not visible in FIGS. 5 and 6, and a longitudinally extending card slot 320 that is configured to receive the mating edge 122 of the card edge module 114 (FIG. 1). The housing 310 holds a plurality of electrical contacts 322 arranged in rows on each side of the card shot 320. The card slot 320 has a transverse width 324.

The detailed description that follows will focus on the housing end portion 321. It is to be understood however that the description is also applicable to the opposite end portion which is not shown. A protective member 330 is provided proximate the end portion 314. The protective member 330 is positioned to inhibit contact between the side edges 126 of the card edge module 114 (FIG. 1) and the end portion 314 of the housing 310 when the card edge module 114 is loaded into the connector 300, thereby shielding the end portion 314 from wear at the card slot 320. The protective member 330 is formed from a planar sheet of material and has a front surface 332 and an opposite rear surface 334. As with the protective member 160 (FIG. 3) previously described, the protective member 330 may be fabricated from stainless steel or any material that is harder than or can resist abrasion from the substrate 120 of the card edge module 114 (FIG. 1), with stainless steel offering the particular advantage of being durable without plating or coating.

The protective member 330 includes a body 340 that extends along a longitudinal axis 342 and has a transverse width 344 between side edges 346. A front surface 348 of the body 340 provides a wear surface that is configured to engage the side edges 126 of the card edge module 114 (FIG. 1) when the protective member 330 is installed in the housing 310. The protective member 330 includes a ramped section 350 that extends upwardly and rearwardly from an upper portion of the body 340 to an upper section 352 that extends rearwardly in a direction that is substantially perpendicular to the body 340. When the protective member 330 is installed in the housing 310, the upper section 352 is substantially parallel with the upper face 316 of the housing 310. A bend 354 joins a downwardly extending retention element 356 to the upper section 352. The retention element 356 may comprise a retention tab and includes retention bumps 358 formed on side edges 360 of the retention element 356. Only one side edge 360 of the retention element 356 is visible in FIG. 6.

A channel 370 is formed in the housing 310 at the end portion 314. The channel 370 is transverse to the card slot 320 and is sized to receive the body 340 of the protective member 330. The channel 370 is open to the card slot 320 such that when the protective member 330 is installed in the channel 370, the front surface 348 of the body 340 is at least partially exposed to the card slot 320. The channel 370 includes end or corner portions 372 with channel end walls 374. A rear wall 378 of the channel 370 faces the card slot 320. In some embodiments, wherein the width 344 of the body 340 does not exceed the width 324 of the card slot 320, the channel may comprise a rearward recess in the end portion 314 that extends rearwardly from the card slot 320. A sloped surface 382 extends rearwardly and upwardly from the rear wall 378 of the channel 370 at substantially the same angle as that of the ramped section 350 of the protective member 330. The sloped surface 382 extends to a recess 384 that is sized to receive the upper section 352 of the protective member 330. The recess 384 extends to a retention slot 390 formed in the end portion 314 that is positioned and sized to receive the retention element 356 of the protective member 330. The retention slot 390 includes side walls 392. When the protective member 330 is installed in the housing 310, the retention bumps 358 on the retention element 356 engage the side walls 392 of the retention slot 390 to frictionally retain the protective member 330 in the housing 310.

The protective member 330 is inserted into the housing 310 in the direction of the arrow C which is substantially the same as the loading direction A (FIG. 1) of the card edge module 114 (FIG. 1). When the protective member 330 is fully inserted in the housing 310, the ramped section 350 of the protective member 330 rests on the sloped surface 382 of the housing 310 and the upper section 352 of the protective member 330 is seated in the recess 384 in the housing 310. As with the protective member 160 previously described, once completely installed, the protective member 330 is not intended to be removed.

When the protective member 330 is installed in the housing 310, the ramped section 350 acts as a guide to lead the mating edge 122 of the card edge module 114 (see FIG. 2) into the card slot 320. The provision of the ramped section 350 minimizes damage to the mating edge 122 of the card edge module 114 during loading that might result from impact with an edge of the housing 310 that would otherwise be present at the end of the card slot 320. As the card edge module 114 is seated in the card slot 320, the exposed front surface 348 of the protective member body 340 engages the side edges 126 (FIG. 2) of the card edge module 114 thereby shielding the housing end portion 314 from abrasion and wear.

The embodiments thus described provide a socket connector 110 including a protective member 160, 330 that facilitates shielding the end portions 134, 136, 314 of the connector housing 130, 310 from abrasive wear from side edges 126 of a card edge module 114 during loading of the card edge module 114 in the connector 110, 300. The protective member 160, 330 comprises an insert that is installed in a channel 200, 370 proximate end portions 134, 136, 314 of the connector housing 130, 310. The protective member 160, 330 is fabricated from a material such as stainless steel that can withstand the abrasiveness of the substrate material of the card edge module 114.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based 35 U.S.C. §112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. A connector for connecting a card edge module to a circuit board, said connector comprising:

a housing extending along a longitudinal axis from one end portion to an opposing end portion of the housing, the housing including a card slot elongated along the longitudinal axis from a first interior wall to an opposing second interior wall and configured to receive a mating edge of the card edge module, the housing including a sloped surface extending from the first interior wall and angled toward the corresponding end portion; and a protective member received in the housing proximate to the first interior wall and positioned to inhibit contact between a side of the mating edge of the card edge module and the first interior wall when the card edge module is loaded into the connector, the protective member having a shape that substantially conforms to the first interior wall and the sloped surface.

2. The connector of claim 1, wherein said protective member includes a body having a front surface configured to engage the side of the card edge module when the card edge module is loaded into the connector and a rear surface that contacts the first interior wall and sloped surface of the housing when the protective member is loaded into the housing.

3. The connector of claim 1, wherein said protective member includes a body and retention elements that extend laterally from the protective member such that the retention elements are received in the housing and are oriented transverse to the card slot to retain said protective member in said housing.

4. The connector of claim 1, wherein said protective member includes a body, a ramped section extending upwardly from said body, and an upper section that extends from said ramped section in a direction that is substantially perpendicular to said body, wherein, when the protective member is loaded into the housing, the body contacts the first interior wall of the housing, the ramped section contacts the sloped surface of the housing, and said upper section contacts at least a portion of said housing proximate an upper surface of the housing.

5. The connector of claim 1, wherein said protective member includes a body, a ramped section extending upwardly from said body, an upper section that extends from said ramped section and a retention element that extends downwardly from said upper section, said retention element inserted into said housing to retain said protective member in said housing.

6. The connector of claim 1, wherein at least one of said end portions includes a recess, and wherein said protective member includes a ramped section and an upper section and wherein said sloped surface is configured to engage said ramped section and said recess is sized to receive said upper section when the protective member is loaded into a channel of the housing.

7. The connector of claim 1, wherein said protective member includes a ramped section configured to engage the mating edge of the card edge module to guide the card edge module along the longitudinal axis into said card slot.

8. The connector of claim 1, wherein said protective member includes a protrusion formed on a rear surface thereof, and wherein said protrusion engages the first interior wall to bias said protective member in a direction along the longitudinal axis of said housing toward the second interior wall.

9. The connector of claim 1, wherein the protective member has a shape that substantially conforms to the first interior wall and the sloped surface such that the protective member simultaneously contacts the first interior wall and the sloped surface.

10. The connector of claim 1, wherein the housing comprises a channel in the first interior wall that receives the protective member, wherein the channel and the card slot are disposed transverse to one another along an upper surface of the housing.

11. The connector of claim 10, wherein said channel comprises a recess formed in said end portion, the sloped surface merging into the recess.

12. The connector of claim 10, wherein said protective member includes retention elements extending from the protective member in opposing directions, the retention elements including retention bumps protruding from opposing sides of the protective member to engage the housing inside the channel and to frictionally retain said protective member in said channel.

13. The connector of claim 1, wherein the housing receives the protective member through an opening in an upper surface of the housing and into the end portion to hold the protective member transverse to the longitudinal axis.

14. The connector of claim 1, wherein the protective member is slidably engageable in the first interior wall of the corresponding end portion.

15. The connector of claim 1, wherein the end portions of the housing are connected by opposing sides of the housing, the sides extending approximately parallel to the longitudinal axis.

16. The connector of claim 1, wherein each of the end portions includes one of the interior walls and the sloped surface.

17. A protective member for an electrical connector extending between opposing end portions, the connector configured to receive a card edge module in a card slot extending along a longitudinal axis from a first interior wall to an opposing second interior wall in the connector, the protective member comprising:

a planar body oriented along an extension axis and received in a channel in the first interior wall such that the extension axis is transverse to the longitudinal axis when the body is loaded into the connector; and a ramped section extending from said body at an angle with respect to the extension axis, the ramped section contacting the card edge module to guide the card edge module along the longitudinal axis and into the card slot, wherein the protective member inhibits contact between a side of the card edge module and the first interior wall of the connector.

18. The protective member of claim 17, wherein said ramped section extends upwardly and rearwardly from said body between the extension axis and the longitudinal axis when the body is loaded into the connector, wherein the protective member further includes an upper section that extends from said ramped section in a direction that is substantially perpendicular to said extension axis, said upper section engaging at least a portion of the connector.

19. The protective member of claim 17, further comprising a retention element including retention bumps protruding from opposing sides of the protective member to frictionally engage the connector to retain the protective member in the connector.

20. The protective member of claim 19, wherein said retention element comprises retention arms extending from opposing sides of said body and wherein said ramped section is positioned between said retention arms.

21. The protective member of claim 19, wherein the protective member further includes an upper section and wherein said retention element comprises a retention tab that extends downwardly from said upper section.

22. The protective member of claim 17, wherein the body includes a protrusion configured to engage the first interior wall of the connector housing to bias the protective member along the longitudinal axis of the connector.

23. The protective member of claim 17, wherein said body comprises a wear surface of the protective member.

24. The protective member of claim 17, wherein said ramped section is configured to engage a mating edge of the card edge module to guide the card edge module along the longitudinal axis into the connector.

25. The connector of claim 17, wherein the protective member is slidably engageable in the first interior wall of the connector.

* * * * *